US011670232B2

(12) United States Patent
Pyun et al.

(10) Patent No.: US 11,670,232 B2
(45) **Date of Patent: *Jun. 6, 2023**

(54) PIXEL OF AN ORGANIC LIGHT EMITTING DIODE DISPLAY DEVICE, AND ORGANIC LIGHT EMITTING DIODE DISPLAY DEVICE

(71) Applicant: Samsung Display Co., Ltd., Yongin-Si (KR)

(72) Inventors: Kihyun Pyun, Gwangmyeong-si (KR); Siduk Sung, Hwaseong-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/579,429

(22) Filed: Jan. 19, 2022

(65) Prior Publication Data

US 2022/0148507 A1 May 12, 2022

Related U.S. Application Data

(63) Continuation of application No. 17/192,779, filed on Mar. 4, 2021, now Pat. No. 11,257,431.

(30) Foreign Application Priority Data

Jun. 11, 2020 (KR) ..... 10-2020-0070916

(51) Int. Cl.

| | |
|---|---|
| ***G09G 3/3233*** | (2016.01) |
| ***G09G 3/3266*** | (2016.01) |
| ***G09G 3/3291*** | (2016.01) |

(52) U.S. Cl.
CPC ..... *G09G 3/3233* (2013.01); *G09G 3/3266* (2013.01); *G09G 3/3291* (2013.01);
(Continued)

(58) Field of Classification Search
CPC .. G09G 3/3233; G09G 3/3266; G09G 3/3291; G09G 2300/0842; G09G 2320/0233; G09G 2330/021
See application file for complete search history.

(56) References Cited

U.S. PATENT DOCUMENTS 9,224,335 B2 12/2015 Yoon et al.
11,257,431 B2 * 2/2022 Pyun ..... G09G 3/3266

FOREIGN PATENT DOCUMENTS

KR 10-0537020 B1 3/2006
KR 10-0741890 B1 7/2007
(Continued)

*Primary Examiner* — Stacy Khoo
(74) *Attorney, Agent, or Firm* — Innovation Counsel LLP

(57) ABSTRACT

A display device includes a switch, an initialization line, a capacitor, a data line, a first transistor, a second transistor, a driving transistor, and a diode. The capacitor includes a first electrode and a second electrode. To the first electrode through at least the initialization line, the switch may output a first voltage in a first period of a horizontal time and may output a second voltage unequal to the first voltage in a second period of the horizontal time. The first transistor may connect the data line to the first electrode in response to a scan signal. The driving transistor may provide a driving current based on a voltage of the first electrode. The second transistor may connect the initialization line to the second electrode in response to an initialization signal. The diode may emit light based on the driving current.

20 Claims, 10 Drawing Sheets

(52) U.S. Cl.
CPC ..... *G09G 2300/0842* (2013.01); *G09G 2320/0233* (2013.01); *G09G 2330/021* (2013.01)

(56) References Cited

FOREIGN PATENT DOCUMENTS

| | | | |
|---|---|---|---|
| KR | 10-2010-0054895 | A | 5/2010 |
| KR | 10-0995630 | B1 | 11/2010 |
| KR | 10-1049001 | B1 | 7/2011 |
| KR | 10-1130903 | B1 | 3/2012 |

* cited by examiner

PIXEL OF AN ORGANIC LIGHT EMITTING DIODE DISPLAY DEVICE, AND ORGANIC LIGHT EMITTING DIODE DISPLAY DEVICE

CROSS-REFERENCE TO RELATED APPLICATIONS

This application is a continuation application of U.S. application Ser. No. 17/192,779, which was filed on Mar. 4, 2021 and claims priority under 35 USC § 119 to Korean Patent Application No. 10-2020-0070916 filed on Jun. 11, 2020 in the Korean Intellectual Property Office (KIPO); the prior applications are incorporated by reference.

BACKGROUND

1. Field

The technical field relates to organic light emitting diode (OLED) display devices.

2. Description of the Related Art

A pixel of an organic light emitting diode (OLED) display device may store a data voltage in a storage capacitor within a gate on time (or a scan on time), i.e., one horizontal time (or 1H time). If a resolution or a driving frequency of a display panel is high, the gate on time (or the 1H time) may short. For example, the 1H time for a display panel having a resolution of about 8K and a driving frequency of about 60 Hz may be about 3.7 μs, and the 1H time for a display panel having a resolution of about 8K and a driving frequency of about 120 Hz may be reduced to a half of about 3.7 μs, or about 1.85 μs. If the gate on time is short, a charging rate of the storage capacitor may not be sufficient to store the data voltage. As a result, insufficient data voltage may be stored in the storage capacitor, and thus the pixel may not emit light with desired luminance.

SUMMARY

Embodiments may be related a pixel of an organic light emitting diode (OLED) display device having a desirable charging rate.

Embodiments may be related to an OLED display device that includes pixels with desirable charging rates and displays images with sufficient luminance.

According to embodiments, a pixel of an OLED display device includes a storage capacitor coupled between a first node and a second node, a first switching transistor configured to couple a data line to the first node in response to a scan signal, a driving transistor configured to generate a driving current based on a voltage of the first node, a second switching transistor configured to couple an initialization line to the second node in response to an initialization signal, and an organic light emitting diode configured to emit light based on the driving current. The pixel performs a first reset operation that resets the first node to a first initialization voltage of the initialization line in a first period of a previous horizontal time, and performs a second reset operation that resets the first node to a second initialization voltage of the initialization line different from the first initialization voltage in a second period of the previous horizontal time.

In embodiments, the second initialization voltage may be lower than the first initialization voltage.

In embodiments, the second initialization voltage may be lower than a lowest data voltage.

In embodiments, the scan signal may have an off voltage in the first period and the second period of the previous horizontal time, the initialization signal may have an on voltage in the first period and the second period of the previous horizontal time, and the second switching transistor may be turned on in response to the initialization signal having the on voltage in the first period and the second period of the previous horizontal time.

In embodiments, the scan signal and the initialization signal may have an on voltage in a first period of a current horizontal time, and may have an off voltage in a second period of the current horizontal time.

In embodiments, the first switching transistor may transfer a data voltage of the data line to the first node in response to the scan signal having the on voltage in the first period of the current horizontal time, and the second switching transistor may transfer the first initialization voltage of the initialization line to the second node in response to the initialization signal having the one voltage in the first period of the current horizontal time.

In embodiments, an initial gate-source voltage of the first switching transistor at a start time point of the first period of the current horizontal time may be a constant voltage.

In embodiments, the initial gate-source voltage of the first switching transistor may be a voltage where the second initialization voltage is subtracted from the on voltage of the scan signal.

In embodiments, a final gate-source voltage of the first switching transistor at an end time point of the first period of the current horizontal time may be changed according to the data voltage.

In embodiments, the final gate-source voltage of the first switching transistor may be a voltage where the data voltage is subtracted from the on voltage of the scan signal.

In embodiments, a direction of a current path formed between the data line and the first node in the first period of the current horizontal time may be constant regardless of a voltage level of the data voltage.

In embodiments, the current path may be formed to have the direction from the data line to the first node in the first period of the current horizontal time.

In embodiments, the storage capacitor may include a first electrode coupled to the first node, and a second electrode coupled to the second node, the first switching transistor may include a gate receiving the scan signal, a first terminal coupled to the data line, and a second terminal coupled to the first node, the driving transistor may include a gate coupled to the first node, a first terminal receiving a first power supply voltage, and a second terminal coupled to the second node, the second switching transistor may include a gate receiving the initialization signal, a first terminal coupled to the second node, and a second terminal coupled to the initialization line, and the organic light emitting diode may include an anode coupled to the second node, and a cathode receiving a second power supply voltage.

In embodiments, the first switching transistor, the driving transistor and the second switching transistor may be NMOS transistors.

According to embodiments, a pixel of an OLED display device includes a storage capacitor including a first electrode coupled to a first node, and a second electrode coupled to a second node, a first switching transistor including a gate receiving a scan signal, a first terminal coupled to a data line, and a second terminal coupled to the first node, a driving transistor including a gate coupled to the first node, a first terminal receiving a first power supply voltage, and a second terminal coupled to the second node, a second switching transistor including a gate receiving an initialization signal, a first terminal coupled to the second node, and a second terminal coupled to an initialization line, and an organic light emitting diode including an anode coupled to the second node, and a cathode receiving a second power supply voltage. The pixel performs a first reset operation that resets the first node to a first initialization voltage of the initialization line in a first period of a previous horizontal time, and performs a second reset operation that resets the first node to a second initialization voltage of the initialization line different from the first initialization voltage in a second period of the previous horizontal time.

According to embodiments, an OLED display device includes a display panel including a plurality of pixels, a data driver configured to provide a data voltage to each of the plurality of pixels, a scan driver configured to provide a scan signal and an initialization signal to each of the plurality of pixels, a power management circuit configured to provide an initialization voltage to each of the plurality of pixels, and a controller configured to control the data driver, the scan driver and the power management circuit. Each of the plurality of pixels includes a storage capacitor coupled between a first node and a second node, a first switching transistor configured to couple a data line to the first node in response to the scan signal, a driving transistor configured to generate a driving current based on a voltage of the first node, a second switching transistor configured to couple an initialization line to the second node in response to the initialization signal, and an organic light emitting diode configured to emit light based on the driving current. Each frame period includes a plurality of horizontal times. The power management circuit generates, as the initialization voltage, a first initialization voltage in a first period of each of the plurality of horizontal times, and generates, as the initialization voltage, a second initialization voltage different from the first initialization voltage in a second period of each of the plurality of horizontal times.

In embodiments, each of the plurality of pixels may perform a first reset operation that resets the first node to the first initialization voltage in the first period of a previous horizontal time of the plurality of horizontal times, and may perform a second reset operation that resets the first node to the second initialization voltage in the second period of the previous horizontal time.

In embodiments, the second initialization voltage may be lower than the first initialization voltage.

In embodiments, the second initialization voltage may be lower than a lowest data voltage.

In embodiments, a direction of a current path formed between the data line and the first node in the first period of a current horizontal time of the plurality of horizontal times may be constant regardless of a voltage level of the data voltage.

An embodiment may be related to a display device. The display device may include a switch, an initialization line, a storage capacitor, a data line, a first switching transistor, a second switching transistor, a driving transistor, and a light emitting diode. The switch may output a first instance of a first initialization voltage in a first period of a first horizontal time and may output a first instance of a second initialization voltage unequal to the first initialization voltage in a second period of the first horizontal time. The initialization line may be electrically connected to the switch. The storage capacitor may include a first electrode and a second electrode. The first switching transistor may electrically connect the data line to the first electrode in response to a scan signal. The driving transistor may provide a driving current based on a voltage of the first electrode. The second switching transistor may electrically connect the initialization line to the second electrode in response to an initialization signal. The light emitting diode may be electrically connected to the second electrode and may emit light based on the driving current. The first electrode may have the first initialization voltage throughout the first period of a first horizontal time and may have the second initialization voltage throughout the second period of the first horizontal time.

An embodiment may be related to a display device. The display device may include a switch, an initialization line, a first node, a second node, a storage capacitor, a data line, a first switching transistor, a second switching transistor, a driving transistor, and a light emitting diode. The switch may output a first instance of a first initialization voltage in a first period of a first horizontal time and may output a first instance of a second initialization voltage unequal to the first initialization voltage in a second period of the first horizontal time. The initialization line may be electrically connected to the switch. The storage capacitor may be electrically connected between the first node and the second node. The first switching transistor may electrically connect the data line to the first node in response to a scan signal. The driving transistor may provide a driving current to the second node based on a voltage of the first node. The second switching transistor may electrically connect the initialization line to the second node in response to an initialization signal. The light emitting diode may be electrically connected to the second node and may emit light based on the driving current. The first node may have the first initialization voltage throughout the first period of a first horizontal time and may have the second initialization voltage throughout the second period of the first horizontal time.

The second initialization voltage may be lower than the first initialization voltage.

The second initialization voltage may be lower than a lowest data voltage of the display device.

The first switching transistor may be off in/throughout each of the first period of the first horizontal time and the second period of the first horizontal time. The second switching transistor may be on in/throughout each of the first period of the first horizontal time and the second period of the first horizontal time.

The first switching transistor and the second switching transistor may be on in a first period of a second horizontal time subsequent to the first horizontal time and may be off in a second period of the second horizontal time.

The first switching transistor may transmit a data voltage to the first node in response to the scan signal in the first period of the second horizontal time. The second switching transistor may transmit a second instance of the first initialization voltage to the second node in the first period of the second horizontal time.

An initial gate-source voltage of the first switching transistor at a start time point of the first period of the second horizontal time may be a constant voltage.

The initial gate-source voltage of the first switching transistor may be equal to the second initialization voltage subtracted from an on voltage of the scan signal.

A final gate-source voltage of the first switching transistor at an end time point of the first period of the second horizontal time may be changed according to the data voltage.

The final gate-source voltage of the first switching transistor may be equal to the data voltage subtracted from an on voltage of the scan signal.

A direction of a current path formed between the data line and the first node may be unchanged throughout the first period of the second horizontal time regardless of a voltage level of the data voltage.

The direction may remain from the data line to the first node throughout the first period of the second horizontal time.

The storage capacitor may include a first electrode electrically (and directly) connected to the first node and may include a second electrode electrically (and directly) connected to the second node. The first switching transistor may include a gate receiving the scan signal, a first terminal electrically connected to the data line, and a second terminal electrically connected to the first node. The driving transistor may include a gate electrically connected to the first node, a first terminal receiving a first power supply voltage, and a second terminal electrically connected to the second node. The second switching transistor may include a gate receiving the initialization signal, a first terminal electrically connected to the second node, and a second terminal electrically connected to the initialization line. The organic light emitting diode may include an anode electrically connected to the second node and may include a cathode receiving a second power supply voltage.

The first switching transistor, the driving transistor, and the second switching transistor may be NMOS transistors.

An embodiment may be related to a display device. The display device may include the following elements: a switch outputting a first instance of a first initialization voltage in a first period of a first horizontal time and outputting a first instance of a second initialization voltage unequal to the first initialization voltage in a second period of the first horizontal time; a initialization line electrically connected to the switch; a first node; a second node; a storage capacitor including a first electrode electrically connected to the first node, and a second electrode electrically connected to the second node; a data line; a first switching transistor including a gate receiving a scan signal, a first terminal electrically connected to the data line, and a second terminal electrically connected to the first node; a driving transistor including a gate electrically connected to the first node, a first terminal receiving a first power supply voltage, and a second terminal electrically connected to the second node; a second switching transistor including a gate receiving an initialization signal, a first terminal electrically connected to the second node, and a second terminal electrically connected to the initialization line; and an organic light emitting diode including an anode electrically connected to the second node, and a cathode receiving a second power supply voltage. The first node may have the first initialization voltage in the first period of a first horizontal time and may have the second initialization voltage in the second period of the first horizontal time.

An embodiment may be related to a display device. The display device may include the following elements: a display panel including a plurality of pixels, wherein the plurality of pixels may include a pixel; a data line; a data driver configured to provide a data voltage through the data line to the pixel; a scan driver configured to provide a scan signal and an initialization signal to the pixel; an initialization line; a power management circuit electrically connected through the initialization line to the pixel, providing a first instance of a first initialization voltage through the initialization line to the pixel in a first period of a first horizontal time, and providing a first instance of a second initialization voltage unequal to the first initialization voltage through the initialization line to the pixel in a second period of the first horizontal time; and a controller configured to control the data driver, the scan driver, and the power management circuit.

The pixel may include: the following elements: a first node; a second node; a storage capacitor electrically connected between the first node and the second node; a first switching transistor configured to electrically connect the data line to the first node in response to the scan signal; a driving transistor configured to provide a driving current based on a voltage of the first node; a second switching transistor configured to electrically connect the initialization line to the second node in response to the initialization signal; and an organic light emitting diode configured to emit light based on the driving current.

The first node may have the first initialization voltage throughout the first period of the first horizontal time and may have the second initialization voltage throughout the second period of the first horizontal time.

The second initialization voltage may be lower than the first initialization voltage.

The second initialization voltage may be lower than a lowest data voltage of the display device.

A direction of a current path formed between the data line and the first node may be unchanged throughout a first period of a second horizontal time subsequent to the first horizontal time regardless of a voltage level of the data voltage.

According to embodiments, a pixel may perform a first reset operation that resets a first node (e.g., a gate node) to a first initialization voltage in a first period of a previous horizontal time, and may perform a second reset operation that resets the first node to a second initialization voltage different from the first initialization voltage in a second period of the previous horizontal time. Accordingly, a current path of a first switching transistor of the pixel may have a constant/consistent direction from a data line to the first node regardless of a voltage level of a data voltage. A gate-source voltage of the first switching transistor may be sufficient, and a charging rate of the pixel may be sufficient.

DETAILED DESCRIPTION OF EMBODIMENTS

Example embodiments are described with reference to the accompanying drawings. Although the terms "first," "second," etc. may be used to describe various elements, these elements should not be limited by these terms. These terms may be used to distinguish one element from another element. A first element may be termed a second element without departing from teachings of one or more embodiments. The description of an element as a "first" element may not require or imply the presence of a second element or other elements. The terms "first," "second," etc. may be used to differentiate different categories or sets of elements. For conciseness, the terms "first," "second," etc. may represent "first-type (or first-set)," "second-type (or second-set)," etc., respectively.

The term "couple" may mean "directly connect," "electrically connect," or "electrically connected through no intervening transistor." The term "connect" may mean "directly connect," "electrically connect," or "electrically connected through no intervening transistor." The term "insulate" may mean "electrically insulate" or "electrically isolate." The term "conductive" may mean "electrically conductive." The term "drive" may mean "operate" or "control." The term "in" may mean "for" or "throughout." The term "different from" may mean "unequal to." A listing of items may mean at least one of the items.

Figure 1:
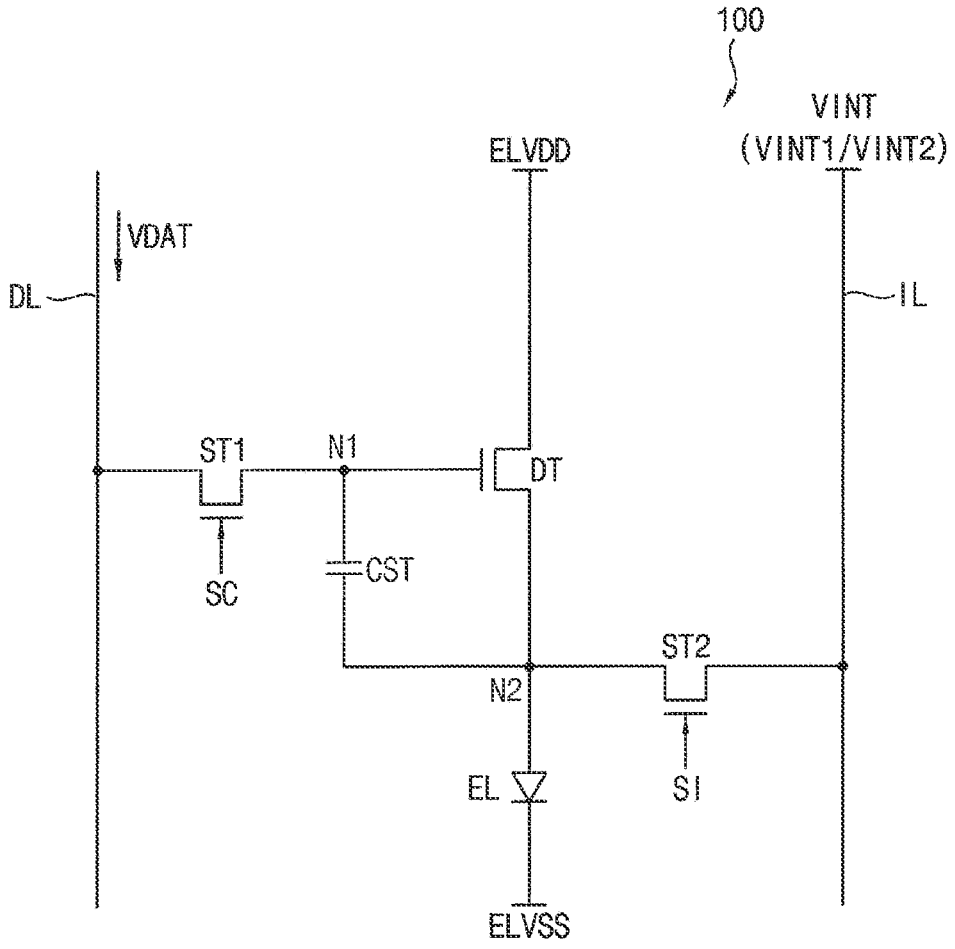
FIG. 1 is a circuit diagram illustrating a pixel of an organic light emitting diode (OLED) display device according to embodiments.

FIG. 1 is a circuit diagram illustrating a pixel of an organic light emitting diode (OLED) display device according to embodiments.

Referring to FIG. 1, a pixel 100 may include a storage capacitor CST, a first switching transistor ST1, a driving transistor DT, a second switching transistor ST2 and an organic light emitting diode EL. The pixel 100 may have a 3T1C structure including three transistors ST1, DT and ST2 and one capacitor CST.

The storage capacitor CST may be coupled between a first node N1 and a second node N2. The storage capacitor CST may store a data voltage VDAT transferred through the first switching transistor ST1 from a data line DL. The storage capacitor CST may include a first electrode coupled to the first node N1, and a second electrode coupled to the second node N2.

The first switching transistor ST1 may couple the data line DL to the first node N1 in response to a scan signal SC. When the scan signal SC has an on voltage (e.g., about 20 V), the first switching transistor ST1 may transfer the data voltage VDAT of the data line DL to the first node N1, or the first electrode of the storage capacitor CST. The first switching transistor ST1 may include a gate receiving the scan signal SC, a first terminal coupled to the data line DL, and a second terminal coupled to the first node N1.

The driving transistor DT may generate/provide a driving current based on a voltage of the first node N1, or the data voltage VDAT stored in the storage capacitor CST. The driving transistor DT may include a gate coupled to the first node N1, a first terminal receiving a first power supply voltage ELVDD (e.g., a high power supply voltage), and a second terminal coupled to the second node N2.

The second switching transistor ST2 may couple an initialization line IL to the second node N2 in response to an initialization signal SI. When the initialization signal SI has an on voltage (e.g., about 20 V), the second switching transistor ST2 may transfer an initialization VINT of the initialization line IL to the second node N2, or the second electrode of the storage capacitor CST. The second switching transistor ST2 may include a gate receiving the initialization signal SI, a first terminal coupled to the second node N2, and a second terminal coupled to the initialization line IL.

The organic light emitting diode EL may emit light based on the driving current generated by the driving transistor DT. The organic light emitting diode EL may include an anode coupled to the second node N2, and a cathode receiving a second power supply voltage ELVSS (e.g., a low power supply voltage).

The first switching transistor ST1, the driving transistor DT and the second switching transistor ST2 may be negative channel metal oxide semiconductor (NMOS) transistors.

In the pixel 100, the pixel 100 may perform a first reset operation that resets the first node N1 to a first initialization voltage VINT1 of the initialization line IL in a first period of a previous horizontal time (or a horizontal time for pixels in a previous row (e.g., in an immediately upper row)), and may perform a second reset operation that resets the first node N1 to a second initialization voltage VINT2 of the initialization line IL different from the first initialization voltage VINT1 in a second period of the previous horizontal time.

The second initialization voltage VINT2 may be lower than the first initialization voltage VINT1. For example, the first initialization voltage VINT1 may be about 1 V, and the second initialization voltage VINT2 may be about −5 V. The second initialization voltage VINT2 may be lower than the lowest data voltage of the display device. For example, the data voltage VDAT may have a data voltage range from about 1 V corresponding to a 0-gray level to about 11 V corresponding to a 255-gray level, and the second initialization voltage VINT2 may be about −5 V, which is lower than the lowest data voltage of about 1 V.

In a case where no reset operation is performed, when a current data voltage VDAT (the data voltage VDAT in a current frame period) is written to the storage capacitor CST, according to a previous data voltage (the data voltage VDAT in a previous frame period) at the first node N1 and the current data voltage VDAT of the data line DL, a current path of the first switching transistor ST1 may have a direction from the data line DL to the first node N1, or a direction from the first node N1 to the data line DL. Further, according to the direction of the current path of the first switching transistor ST1, a gate-source voltage of the first switching transistor ST1 may be determined as a difference between the on voltage of the scan signal SC and the current data voltage VDAT, or as a difference between the on voltage of the scan signal SC and the voltage of the first node N1 (or the previous data voltage at a start time point of a data writing operation). Thus, the gate-source voltage of the first switching transistor ST1 may be changed by the previous data voltage and/or the current data voltage VDAT.

According to embodiments, the first node N1 may be reset by the first reset operation to the first initialization voltage VINT1 in the first period of the previous horizontal time, and then may be further reset by the second reset operation to the second initialization voltage VINT2 in the second period of the previous horizontal time. Accordingly, in a first period of a current horizontal time (or a horizontal time for a row in which the pixel 100 is located), the data voltage VDAT of the data line DL may be higher than the voltage of the first node N1, or the second initialization voltage VINT2, and thus the current path of the first switching transistor ST1 formed between the data line DL and the first node N1 in the first period of the current horizontal time may have a constant/consistent/unchanged direction from the data line DL to the first node N1 regardless of a voltage level of the data voltage VDAT. An initial gate-source voltage of the first switching transistor ST1 at a start time point of the first period of the current horizontal time may be a constant voltage regardless of the voltage level of the data voltage VDAT, and may be sufficiently high. For example, the initial gate-source voltage of the first switching transistor ST1 may be determined as a voltage (e.g., about 25 V) equal to the second initialization voltage VINT2 (e.g., about −5 V) subtracted from the on voltage (e.g., about 20 V) of the scan signal. Accordingly, since the (initial) gate-source voltage of the first switching transistor ST1 is sufficiently high, a current transfer capability of the first switching transistor ST1 may be sufficient, and a charging rate of the pixel 100 (e.g., a charging rate of the storage capacitor CST) may be sufficient.

An example of an operation of the pixel 100 of the OLED display device is described with reference to FIGS. 1 through 7.

Figure 2:
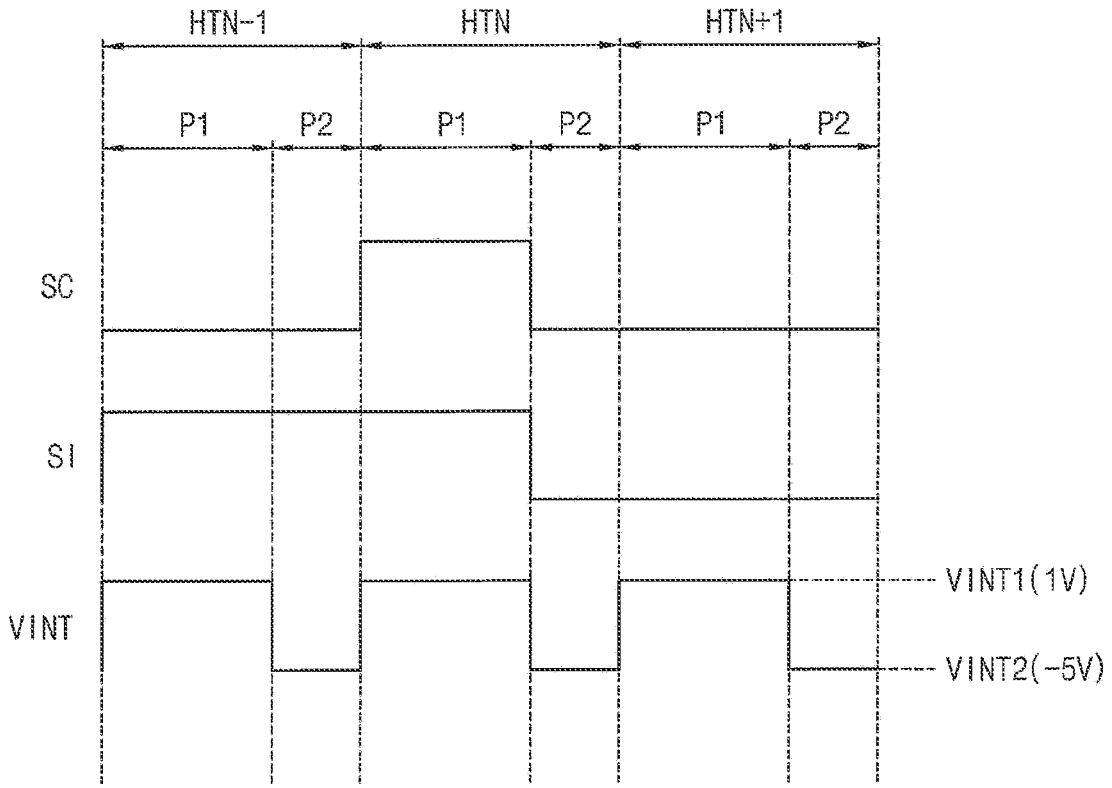
FIG. 2 is a timing diagram for describing an example of an operation of a pixel of an OLED display device according to embodiments.
Figure 3:
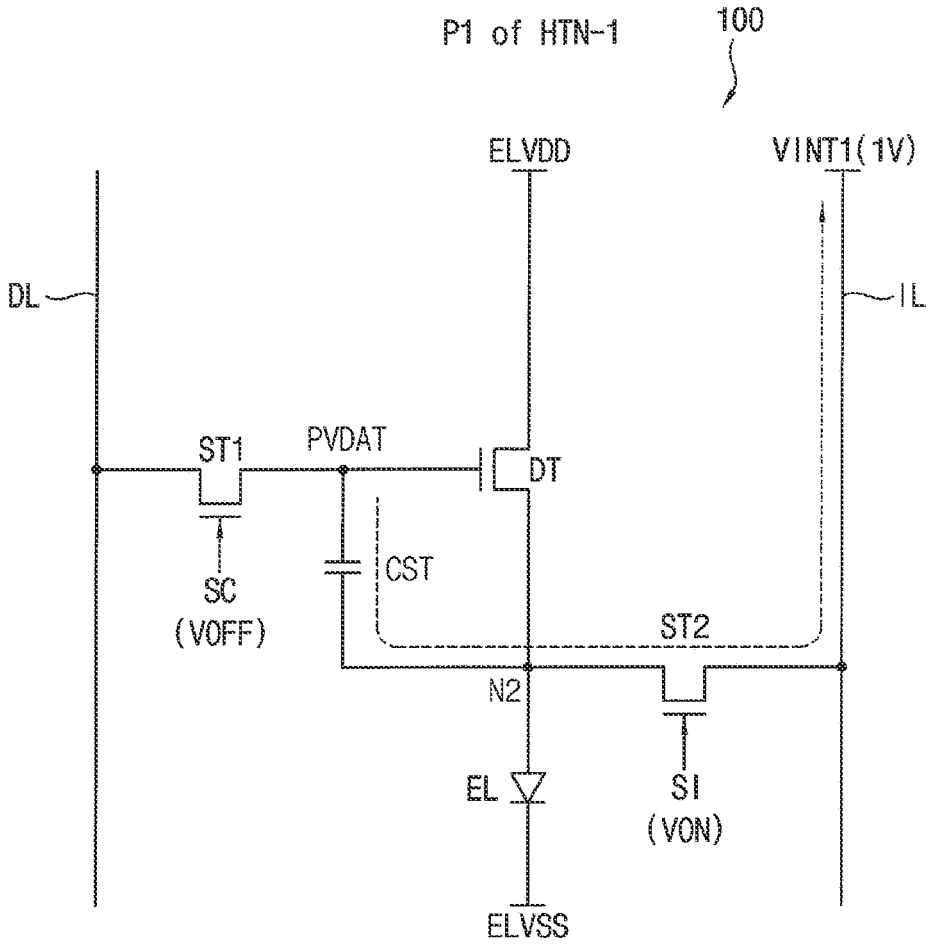
FIG. 3 is a circuit diagram for describing a first reset operation of a pixel in a first period of a previous horizontal time according to embodiments.
Figure 4:
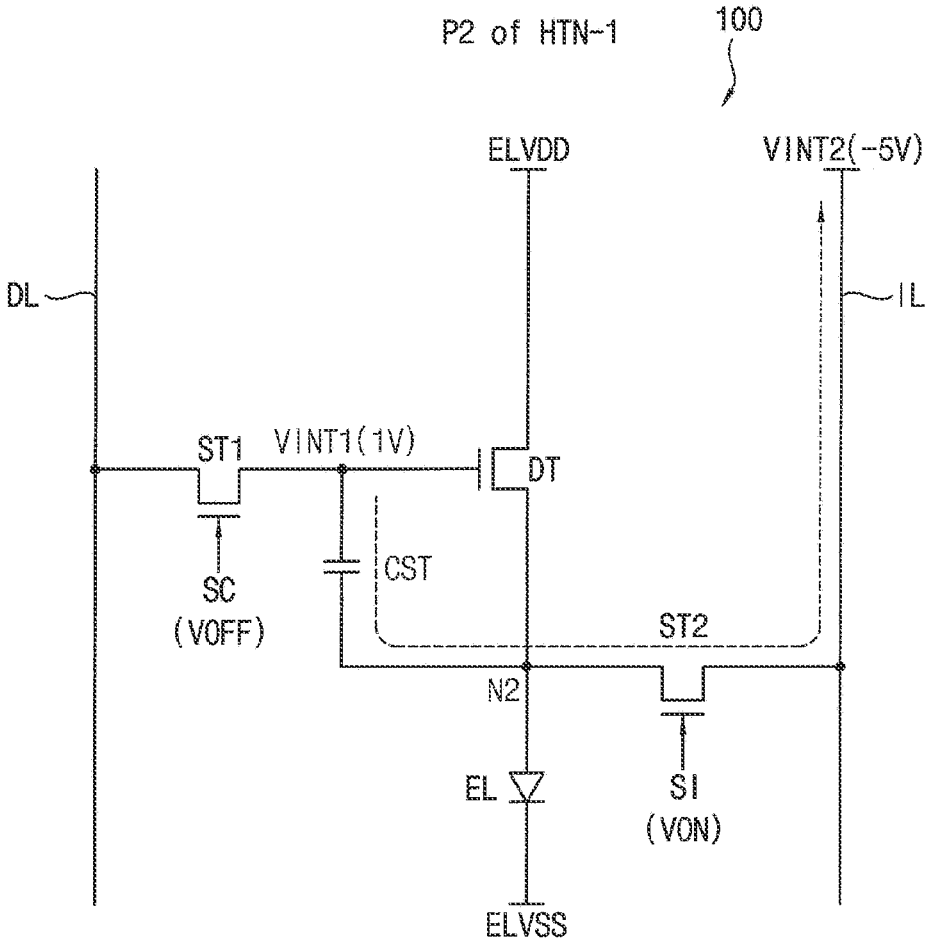
FIG. 4 is a circuit diagram for describing a second reset operation of a pixel in a second period of a previous horizontal time according to embodiments.
Figure 5:
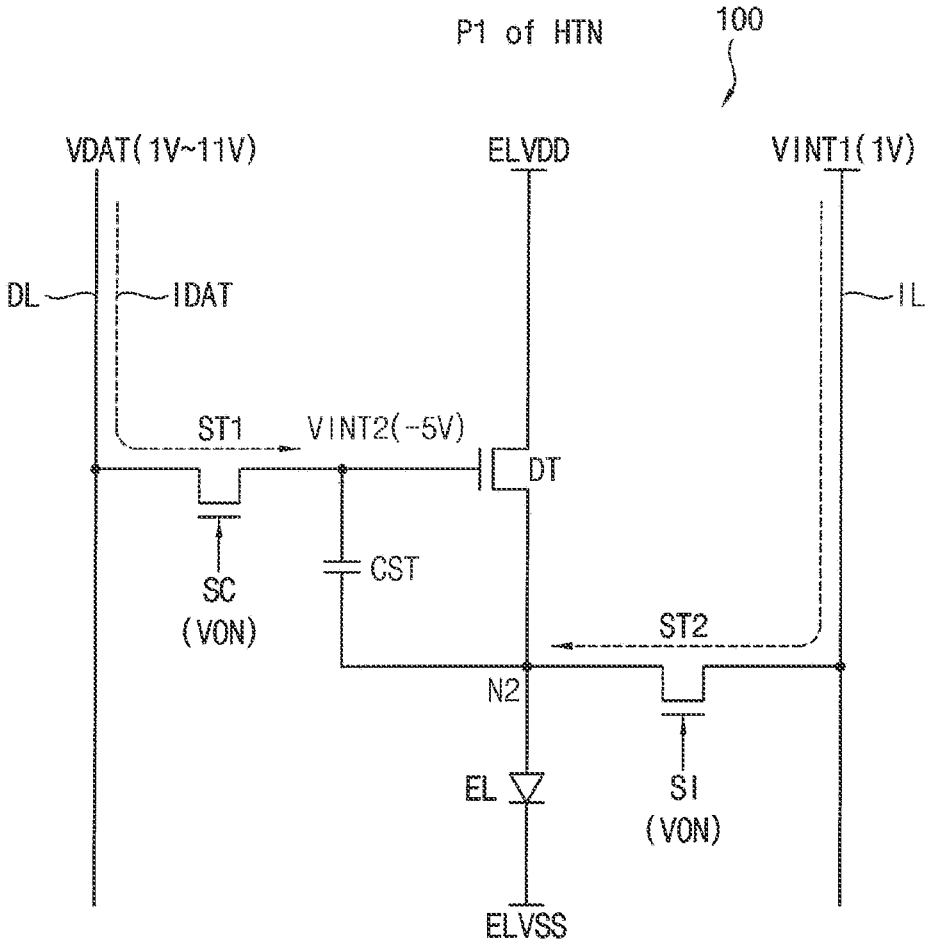
FIG. 5 is a circuit diagram for describing a data writing operation of a pixel in a current horizontal time according to embodiments.
Figure 6:
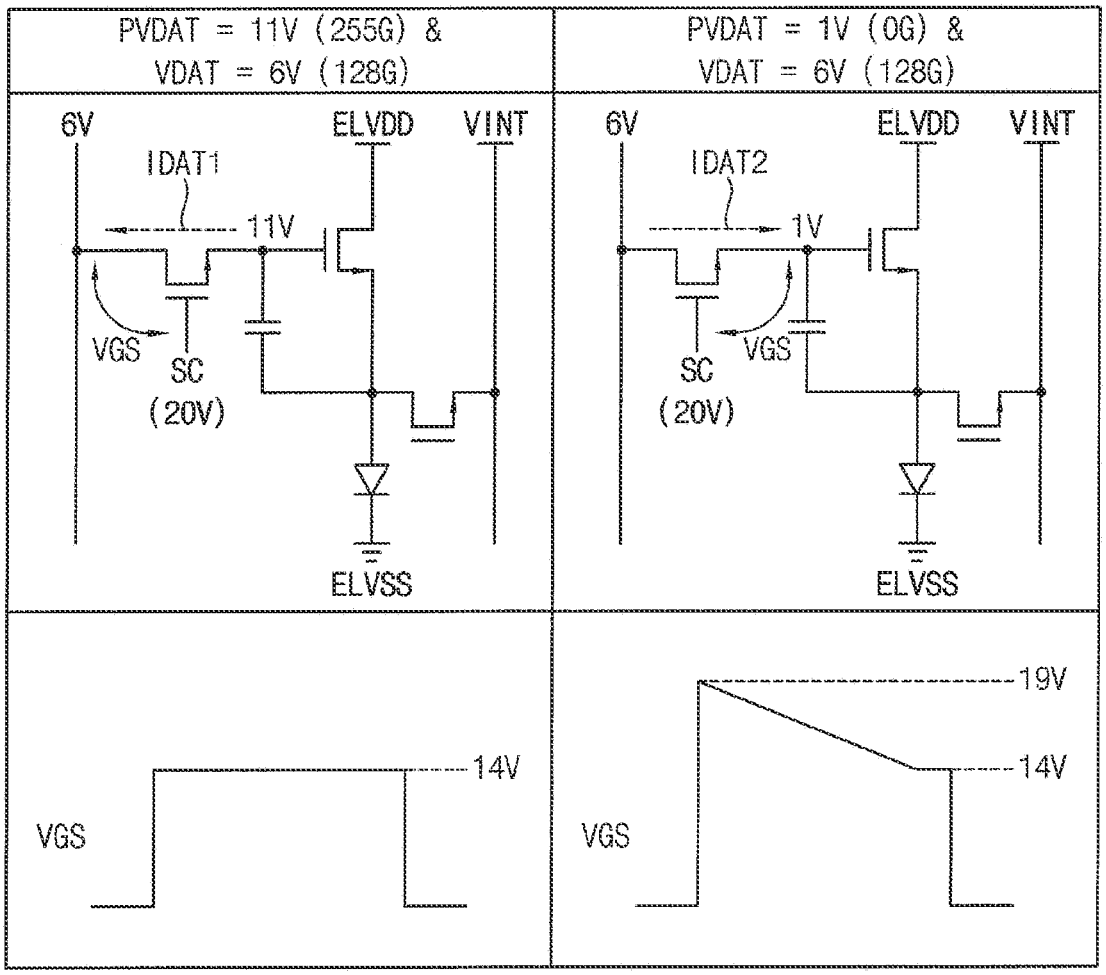
FIG. 6 is a diagram for describing examples of a gate-source voltage of a first switching transistor when no reset operation is performed according to embodiments.
Figure 7:
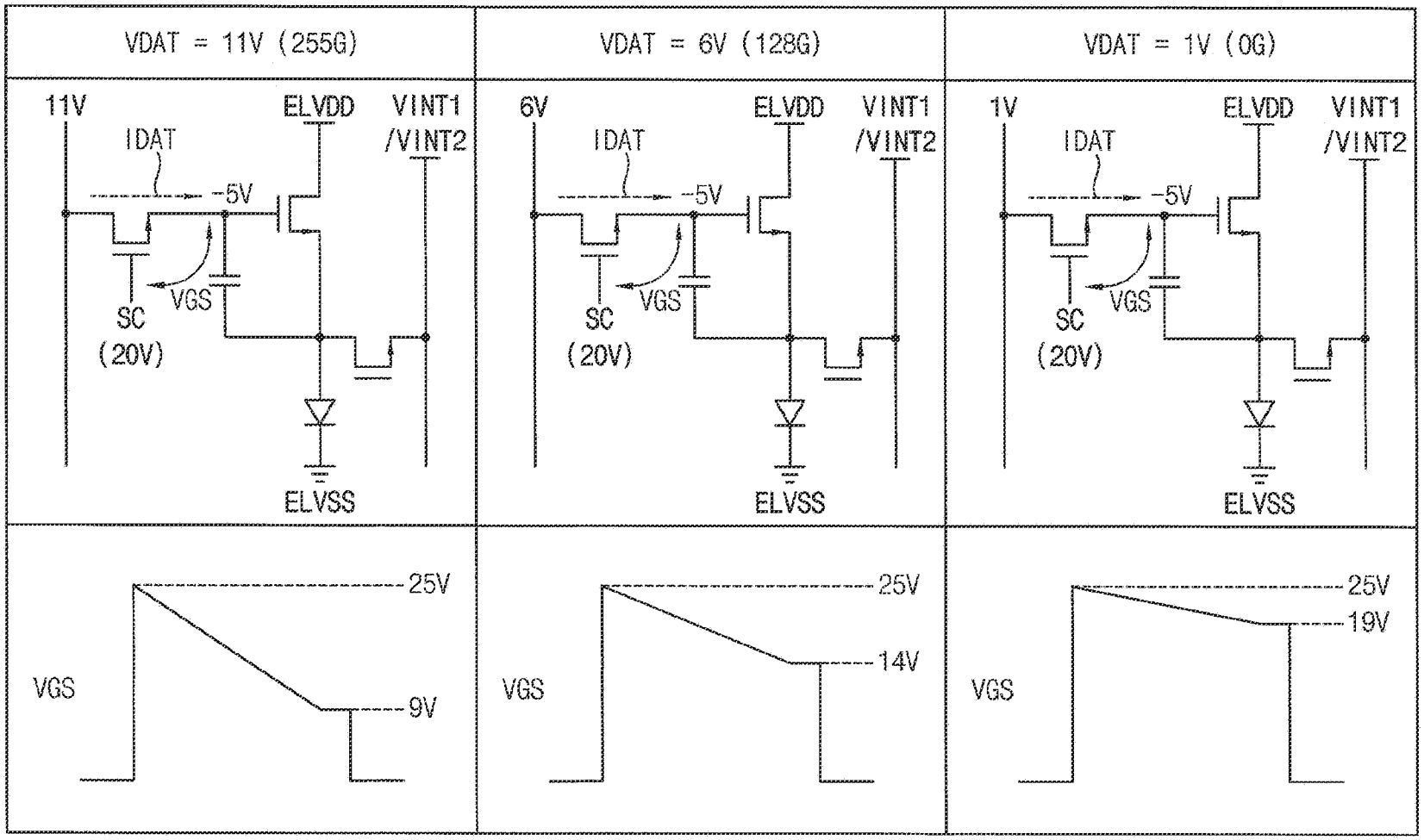
FIG. 7 is a diagram for describing examples of a gate-source voltage of a first switching transistor in a pixel that performs reset operations according to embodiments.

FIG. 2 is a timing diagram for describing an example of an operation of a pixel of an OLED display device, FIG. 3 is a circuit diagram for describing a first reset operation of a pixel in a first period of a previous horizontal time, FIG. 4 is a circuit diagram for describing a second reset operation of a pixel in a second period of a previous horizontal time, FIG. 5 is a circuit diagram for describing a data writing operation of a pixel in a current horizontal time, FIG. 6 is a diagram for describing examples of a gate-source voltage of a first switching transistor in when no reset operation is performed, and FIG. 7 is a diagram for describing examples of a gate-source voltage of a first switching transistor in a pixel that performs reset operations.

Referring to FIGS. 1 and 2, each frame period of an OLED display device including a pixel 100 may include horizontal times HTN−1, HTN and HTN+1 respectively corresponding to pixel rows of the OLED display device. For example, if the OLED display device includes M pixel rows, where M is an integer greater than 1, each frame period may include M (or, alternatively, M+1) horizontal times. FIG. 2 illustrates an example where an N-th horizontal time HTN is a current horizontal time for a pixel row including the pixel 100, and an (N−1)-th horizontal time HTN−1 is a previous horizontal time for a previous/neighboring pixel row, where N is an integer greater than 1 and less than M. Each horizontal time HTN−1, HTN and HTN+1 may be divided into a first period P1 and a second period P2. An initialization voltage VINT of an initialization line IL may be a first initialization voltage VINT1 in the first period P1 of each of horizontal times HTN−1, HTN and HTN+1, and may be a second initialization voltage VINT2 different from the first initialization voltage VINT1 in the second period P2 of each of horizontal times HTN−1, HTN and HTN+1. For example, the first initialization voltage VINT1 may be about 1 V, and the second initialization voltage VINT2 may be about −5 V.

Referring to FIGS. 2 and 3, in the first period P1 of the previous horizontal time HTN−1, a scan signal SC may have an off voltage VOFF, and an initialization signal SI may have an on voltage VON. A first switching transistor ST1 may be turned off in response to the scan signal SC having the off voltage VOFF, and a second switching transistor ST2 may be turned on in response to the initialization signal SI having the on voltage VON. At a start time point of the first period P1 of the previous horizontal time HTN−1 a first node N1, or a first electrode of a storage capacitor CST, may have a previous data voltage PVDAT for the data voltage VDAT. During the first period P1 of the previous horizontal time HTN−1, the first initialization voltage VINT1 may be applied to a second node N2, or a second electrode of the storage capacitor CST. Accordingly, in the first period P1 of the previous horizontal time HTN−1, the second node N2 may have the first initialization voltage VINT1, and the first node N1 may be changed (e.g., by a leakage current of the storage capacitor CST) from the previous data voltage PVDAT to the first initialization voltage VINT1 (or to a voltage close to the first initialization voltage VINT1). This operation where a voltage of the first node N1 is changed to the first initialization voltage VINT1 (or to the voltage close to the first initialization voltage VINT1) may be referred to as a first reset operation using the first initialization voltage VINT1.

Referring to FIGS. 2 and 4, in the second period P2 of the previous horizontal time HTN−1, the scan signal SC may be maintained as the off voltage VOFF, the initialization signal SI may be maintained as the on voltage VON, and the initialization voltage VINT of the initialization line IL may be changed from the first initialization voltage VINT1 to the second initialization voltage VINT2. The second initialization voltage VINT2 may be lower than the first initialization voltage VINT1. For example, the first initialization voltage VINT1 may be about 1 V, and the second initialization voltage VINT2 may be about −5 V. The second initialization voltage VINT2 may be lower than the lowest data voltage of the display device. For example, the data voltage VDAT may have a data voltage range from about 1 V corresponding to a 0-gray level to about 11 V corresponding to a 255-gray level, and the second initialization voltage VINT2 may be about −5 V, which is lower than the lowest data voltage of about 1 V. Accordingly, in the second period P2 of the previous horizontal time HTN−1, the second node N2 may have the second initialization voltage VINT2 of about −5 V, and the first node N1 may be changed from the first initialization voltage VINT1 of about 1 V to the second initialization voltage VINT2 of about −5 V (or to a voltage close to the second initialization voltage VINT2 of about −5 V). This operation where the voltage of the first node N1 is changed to the second initialization voltage VINT2 of about −5 V may be referred to as a second reset operation using the second initialization voltage VINT2.

Referring to FIGS. 2 and 5, in the first period P1 of the current horizontal time HTN, the scan signal SC may be changed to the on voltage VON, the initialization signal SI may be maintained as the on voltage VON, and the initialization voltage VINT of the initialization line IL may be changed from the second initialization voltage VINT2 to the first initialization voltage VINT1. In the first period P1 of the current horizontal time HTN, the first switching transistor ST1 may transfer the data voltage VDAT of a data line DL to the first node N1 in response to the scan signal SC having the on voltage VON, and the second switching transistor ST2 may transfer the first initialization voltage VINT1 of the initialization line IL to the second node N2 in response to the initialization signal SI having the on voltage VON. During the first period P1 of the current horizontal time HTN, a data writing operation for the pixel 100 may be performed. That is, during the first period P1 of the current horizontal time HTN, the storage capacitor CST may store a voltage difference between the data voltage VDAT and the first initialization voltage VINT1, and may store the data voltage VDAT at the first node N1, or at the first electrode.

If no reset operation is performed, when the data writing operation is performed, a direction of a current path and a gate-source voltage of the first switching transistor ST1 may be changed. For example, as illustrated in a first/left column of FIG. 6, if the previous data voltage PVDAT is about 11 V corresponding to a 255-gray level 255G, a current data voltage VDAT is about 6 V corresponding to a 128-gray level 128G, and the on voltage VON of the scan signal SC is about 20 V, at a start time point of the data writing operation, the first node N1 may have the previous data voltage PVDAT of about 11 V, and the data line DL may have the current data voltage VDAT of about 6 V. In this case, a first current path IDAT1 of the first switching transistor ST1 may have a direction from the first node N1 to the data line DL, and a first/left terminal of the first switching transistor ST1 coupled to the data line DL may serve as a source of the first switching transistor ST1. Thus, when the data writing operation is performed, the gate-source voltage VGS of the first switching transistor ST1 may be about 14 V, equal to the current data voltage VDAT of about 6 V subtracted from the on voltage VON of about 20 V. As illustrated in a second/right column of FIG. 6, if the previous data voltage PVDAT is about 1 V corresponding to a 0-gray level 0G, the current data voltage VDAT is about 6 V corresponding to the 128-gray level 128G, and the on voltage VON of the scan signal SC is about 20 V, at the start time point of the data writing operation, the first node N1 may have the previous data voltage PVDAT of about 1 V, and the data line DL may have the current data voltage VDAT of about 6 V. In this case, a second current path IDAT2 of the first switching transistor ST1 may have a direction from the data line DL to the first node N1, and a second/right terminal of the first switching transistor ST1 coupled to the first node N1 may serve as the source of the first switching transistor ST1. At an end time point of the data writing operation, the first node N1 may have the current data voltage VDAT of about 6 V. Thus, when the data writing operation is performed, the gate-source voltage VGS of the first switching transistor ST1 may be gradually changed form a voltage of about 19 V (equal to the previous data voltage PDAT of about 1 V subtracted from the on voltage VON of about 20 V) to a voltage of about 14 V (equal to the current data voltage VDAT of about 6 V subtracted from the on voltage VON of about 20 V).

According to embodiments, since the first node N1 is reset by the operations using the first and second initialization voltages VINT1 and VINT2 during the previous horizontal time HTN−1 before the current horizontal time HTN, a direction of a current path IDAT formed between the data line DL and the first node N1 may be constant/unchanged in the first period P1 of the current horizontal time HTN regardless of voltage levels of the previous and current data voltages PVDAT and VDAT. At a start time point of the first period P1 of the current horizontal time HTN, the first node N1 may have the second initialization voltage VINT2 lower than a data voltage range of the display device (from about 1 V to about 11 V), or the lowest data voltage of the display device (about 1 V), and thus, as illustrated in FIG. 7, the current path IDAT of the first switching transistor ST1 may have the constant/consistent/unchanged direction from the data line DL to the first node N1 regardless of whether the current data voltage VDAT is about 1 V corresponding to the 0-gray level 0G, about 6 V corresponding to the 128-gray level 128G, or about 11 V corresponding to the 255-gray level 255G.

According to embodiments, an initial gate-source voltage of the first switching transistor ST1 at the start time point of the first period P1 of the current horizontal time HTN may be a constant voltage regardless of the voltage levels of the previous and current data voltages PVDAT and VDAT. A final gate-source voltage of the first switching transistor ST1 at an end time point of the first period P1 of the current horizontal time HTN may be changed according to the current data voltage VDAT.

Referring to a first/left column of FIG. 7, if the data voltage VDAT is about 11 V corresponding to the 255-gray level 255G, and if the on voltage VON of the scan signal SC is about 20 V, the first node N1 may have the second initialization voltage VINT2 of about −5 V at the start time point of the first period P1 of the current horizontal time HTN, and may have the data voltage VDAT of about 11 V at the end time point of the first period P1 of the current horizontal time HTN. The initial gate-source voltage of the first switching transistor ST1 may be about 25 V, equal to the second initialization voltage VINT2 of about −5 V subtracted from the on voltage VON of about 20 V. The final gate-source voltage of the first switching transistor ST1 may be about 9 V, equal to the data voltage VDAT of about 11 V subtracted from the on voltage VON of about 20 V. The gate-source voltage VGS of the first switching transistor ST1 may be changed from about 25 V to about 9 V during the first period P1 of the current horizontal time HTN.

Referring a second/middle column of FIG. 7, if the data voltage VDAT is about 6 V corresponding to the 128-gray level 128G, and if the on voltage VON of the scan signal SC is about 20 V, the first node N1 may have the second initialization voltage VINT2 of about −5 V at the start time point of the first period P1 of the current horizontal time HTN, and may have the data voltage VDAT of about 6 V at the end time point of the first period P1 of the current horizontal time HTN. The initial gate-source voltage of the first switching transistor ST1 may be about 25 V, equal to the second initialization voltage VINT2 of about −5 V subtracted from the on voltage VON of about 20 V. The final gate-source voltage of the first switching transistor ST1 may be about 14 V, equal to the data voltage VDAT of about 6 V subtracted from the on voltage VON of about 20 V. The gate-source voltage VGS of the first switching transistor ST1 may be changed from about 25 V to about 14 V during the first period P1 of the current horizontal time HTN.

Referring to a third/right column of FIG. 7, if the data voltage VDAT is about 1 V corresponding to the 0-gray level 0G, and if the on voltage VON of the scan signal SC is about 20 V, the first node N1 may have the second initialization voltage VINT2 of about −5 V at the start time point of the first period P1 of the current horizontal time HTN, and may have the data voltage VDAT of about 1 V at the end time point of the first period P1 of the current horizontal time HTN. The initial gate-source voltage of the first switching transistor ST1 may be about 25 V, equal to the second initialization voltage VINT2 of about −5 V subtracted from the on voltage VON of about 20 V. The final gate-source voltage of the first switching transistor ST1 may be about 19 V, equal to the data voltage VDAT of about 1 V subtracted from the on voltage VON of about 20 V. The gate-source voltage VGS of the first switching transistor ST1 may be changed from about 25 V to about 19 V during the first period P1 of the current horizontal time HTN.

According to embodiments, in the first period P1 of the current horizontal time HTN, the data voltage VDAT of the data line DL may be higher than the voltage of the first node N1, or the second initialization voltage VINT2, and thus the current path IDAT of the first switching transistor ST1 may have the constant direction from the data line DL to the first node N1 regardless of the voltage level of the data voltage VDAT. The initial gate-source voltage of the first switching transistor ST1 at the start time point of the first period P1 of the current horizontal time HTN may be a constant voltage (e.g., about 25 V) equal to the second initialization voltage VINT2 (e.g., about −5 V) subtracted from the on voltage (e.g., about 20 V) of the scan signal regardless of the voltage level of the data voltage VDAT. Referring to FIGS. 6 and 7, the gate-source voltage VGS of the first switching transistor ST1 in the pixel 100 performing the reset operations may be relatively high. Since the gate-source voltage VGS of the first switching transistor ST1 is high, a current transfer capability of the first switching transistor ST1 may be sufficient, and a charging rate of the pixel 100 may be sufficient.

Referring to FIGS. 1 and 2, the scan signal SC and the initialization signal SI may be changed to the off voltage VOFF in the second period P2 of the current horizontal time HTN, and the pixel 100 may emit light based on the data voltage VDAT at the first node N1.

Figure 8:
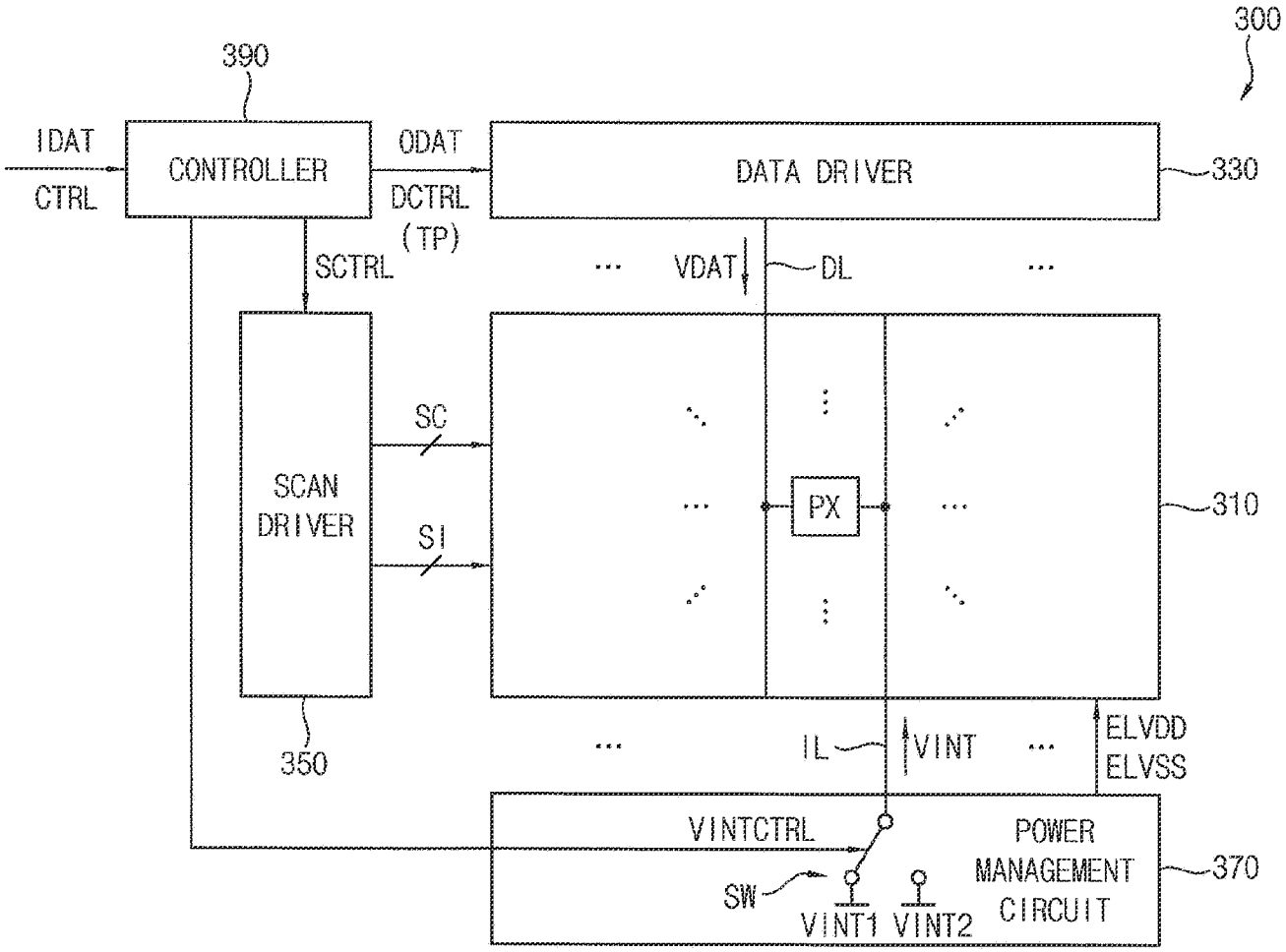
FIG. 8 is a block diagram illustrating an OLED display device according to embodiments.
Figure 9:
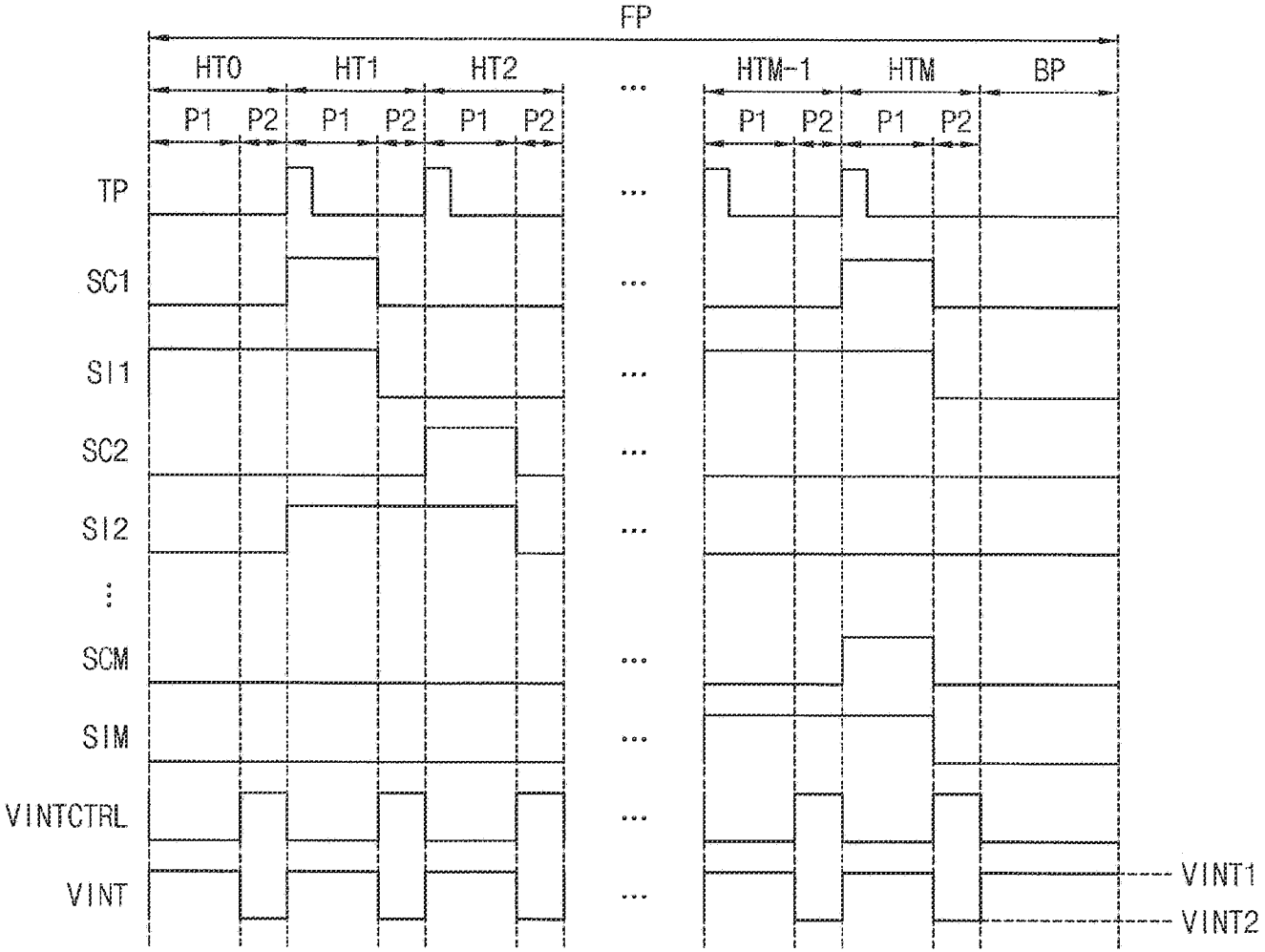
FIG. 9 is a timing diagram for describing an example of an initialization voltage during one frame period of an OLED display device according to embodiments.

FIG. 8 is a block diagram illustrating an OLED display device according to embodiments, and FIG. 9 is a timing diagram for describing an example of an initialization voltage during one frame period of an OLED display device according to embodiments.

Referring to FIG. 8, an OLED display device 300 may include a display panel 310 that includes a plurality of pixels PX, a data driver 330 that provides a data voltage VDAT to at least one of pixels PX, a scan driver 350 that provides a scan signal SC and an initialization signal SI to at least one of pixels PX, a power management circuit 370 that provides an initialization voltage VINT to at least one of pixels PX, and a controller 390 that controls the data driver 330, the scan driver 350 and the power management circuit 370.

The display panel 310 may include a plurality of data lines DL, a plurality of initialization lines IL, a plurality of scan signal lines, a plurality of initialization signal lines, and the plurality of pixels PX coupled to the lines. Each pixel PX of the display panel 310 may be identical to or analogous to a pixel 100 having a 3T1C structure illustrated in FIG. 1. Each pixel PX may receive an initialization voltage VINT that is alternated between a first initialization voltage VINT1 and a second initialization voltage VINT2, from the power management circuit 370. Each pixel PX may perform a first reset operation that resets a first node (e.g., a gate node) to the first initialization voltage VINT1 in a first period of a previous horizontal time, and may perform a second reset operation that resets the first node to the second initialization voltage VINT2 in a second period of the previous horizontal time. Accordingly, a current path of a first switching transistor of each pixel PX may have a constant/consistent direction from the data line DL to the first node regardless of a voltage level of the data voltage VDAT. A gate-source voltage of the first switching transistor of each pixel PX may be sufficient, and thus a charging rate of the pixel PX may be sufficient.

The data driver 330 may generate the data voltages VDAT based on output image data ODAT and a data control signal DCTRL received from the controller 390, and may provide data voltages VDAT to the pixels PX through the data lines DL. The data control signal DCTRL may include a transfer pulse signal TP for controlling output timings of the data voltages VDAT of the data driver 330. The data driver 330 may output the data voltages VDAT for one row of the pixels PX to the plurality of data lines DL at each rising edge of the transfer pulse signal TP. The data control signal DCTRL may further include a horizontal start signal and a load signal. The data driver 330 may be implemented with one or more integrated circuits. The data driver 330 and the controller 390 may be implemented with a single integrated circuit referred to as a timing controller embedded data driver (TED).

The scan driver 350 may generate the scan signals SC and the initialization signals SI based on a scan control signal SCTRL received from the controller 390, may sequentially provide the scan signals SC to the pixels PX on a pixel row basis, and may sequentially provide the initialization signals SI to the pixels PX on the pixel row basis. The scan control signal SCTRL may include a scan start signal and a scan clock signal. The scan driver 350 may be integrated or formed in a peripheral region of the display panel 310. The scan driver 350 may be implemented with one or more integrated circuits.

The power management circuit 370 may provide a first power supply voltage ELVDD, a second power supply voltage ELVSS and the initialization voltage VINT to the plurality of pixels PX. The power management circuit 370 may generate/provide, as the initialization voltage VINT, the first initialization voltage VINT1 in a first period of each horizontal time, and may generate/provide, as the initialization voltage VINT, the second initialization voltage VINT2 different from the first initialization voltage VINT1 in a second period of each horizontal time. To perform this operation, the power management circuit 370 may include a switch SW that receives an initialization voltage control signal VINTCTRL from the controller 390 and selectively outputs (instances of) the first initialization voltage VINT1 or the second initialization voltage VINT2 to the initialization lines IL (coupled to each other) in response to the initialization voltage control signal VINTCTRL. The switch SW may output (instances of) the first initialization voltage VINT1 to the initialization lines IL in response to the initialization voltage control signal VINTCTRL having a low level, and may output (instances of) the second initialization voltage VINT2 to the initialization lines IL in response to the initialization voltage control signal VINTCTRL having a high level. The power management circuit 370 may be implemented with a separate integrated circuit referred to as a power management integrated circuit (PMIC). The power management circuit 370 may be included in the controller 390.

The controller 390 (e.g., a timing controller (TCON)) may receive input image data IDAT and a control signal CTRL from an external host (e.g., a graphic processing unit (GPU), an application processor (AP), or a graphic card). The control signal CTRL may include a vertical synchronization signal, a horizontal synchronization signal, an input data enable signal, a master clock signal, etc. The controller 390 may generate the output image data ODAT, the data control signal DCTRL, the scan control signal SCTRL and the initialization voltage control signal VINTCTRL based on the input image data IDAT and the control signal CTRL. The controller 390 may control an operation of the data driver 330 by providing the output image data ODAT and the data control signal DCTRL to the data driver 330, may control an operation of the scan driver 350 by providing the scan control signal SCTRL to the scan driver 350, and may control an operation of the power management circuit 370 by providing the initialization voltage control signal VINTCTRL to the power management circuit 370.

Referring to FIG. 9, each frame period FP of the OLED display device 300 may include an active period and a blank period BP, and the active period may include horizontal times HT0, HT1, HT2, HTM-1 and HTM respectively corresponding to pixel rows. The display panel 310 may include first through M-th pixel rows, where M is an integer greater than 1; each frame period FP may include a previous horizontal time HT0 for the first pixel row, and may include first through M-th horizontal times HT1, HT2, HTM-1 and HTM that are M current horizontal times for the first through M-th pixel rows. Each of horizontal times HT0, HT1, HT2, HTM-1 and HTM may include a first period P1 and a second period P2. The power management circuit 370 may generate/provide/output the first initialization voltage VINT1 as the initialization voltage VINT in the first period P1 of each of horizontal times HT0, HT1, HT2, HTM-1 and HTM, and may generate/provide/output the second initialization voltage VINT2 as the initialization voltage VINT in the second period P2 of each of horizontal times HT0, HT1, HT2, HTM-1 and HTM.

In the first and second periods P1 and P2 of the previous horizontal time HT0 for the first pixel row, a first initialization signal SI1 for the first pixel row may have an on voltage. In response to the first initialization signal SI1 having the on voltage, the pixels PX in the first pixel row may perform the first reset operation using the first initialization voltage VINT1 in the first period P1 of the previous horizontal time HT0, and may perform the second reset operation using the second initialization voltage VINT2 in the second period P2 of the previous horizontal time HT0. In the first period P1 of the first horizontal time HT1, a first scan signal SC1 and the first initialization signal SI1 for the first pixel row may have the on voltage, and the pixels PX in the first pixel row may perform a data writing operation in response to the first scan signal SC1 and the first initialization signal SI1 having the on voltage. Charging rates of the pixels PX in the first pixel row may be sufficiently high as a result of the first and second reset operations in the previous horizontal time HT0, and the pixels PX in the first pixel row may store the data voltages VDAT having desired voltage levels. In the second period P2 of the first horizontal time HT1, the first scan signal SC1 and the first initialization signal SI1 may be changed to an off voltage.

In the first and second periods P1 and P2 of the first horizontal time HT1, a second initialization signal SI2 for a second pixel row may have the on voltage. In response to the second initialization signal SI2 having the on voltage, the pixels PX in the second pixel row may perform the first reset operation using the first initialization voltage VINT1 in the first period P1 of the first horizontal time HT1, and may perform the second reset operation using the second initialization voltage VINT2 in the second period P2 of the first horizontal time HT1. In the first period P1 of a second horizontal time HT2, a second scan signal SC2 and the second initialization signal SI2 for the second pixel row may have the on voltage, and the pixels PX in the second pixel row may perform the data writing operation in response to the second scan signal SC1 and the second initialization signal SI2 having the on voltage.

Similarly, in the first and second periods P1 and P2 of an (M−1)-th horizontal time HTM-1, an M-th initialization signal SIM for the M-th pixel row may have the on voltage. In response to the M-th initialization signal SIM having the on voltage, the pixels PX in the M-th pixel row may perform the first reset operation using the first initialization voltage VINT1 in the first period P1 of the (M−1)-th horizontal time HTM-1, and may perform the second reset operation using the second initialization voltage VINT2 in the second period P2 of the (M−1)-th horizontal time HTM-1. In the first period P1 of the M-th horizontal time HTM, an M-th scan signal SCM and the M-th initialization signal SIM for the M-th pixel row may have the on voltage, and the pixels PX in the M-th pixel row may perform the data writing operation in response to the M-th scan signal SCM and the M-th initialization signal SIM having the on voltage.

In this manner, in each frame period FP, the pixels PX may perform 2-voltage reset operations and the data writing operation on a pixel row basis in response to the first through M-th scan signals SC1, SC2, SCM and the first through M-th initialization signals SI1, SI2, . . . , SIM that are sequentially applied on the pixel row basis. Since each pixel PX performs the 2-voltage reset operations, the charging rate of the pixel PX may be sufficient.

Figure 10:
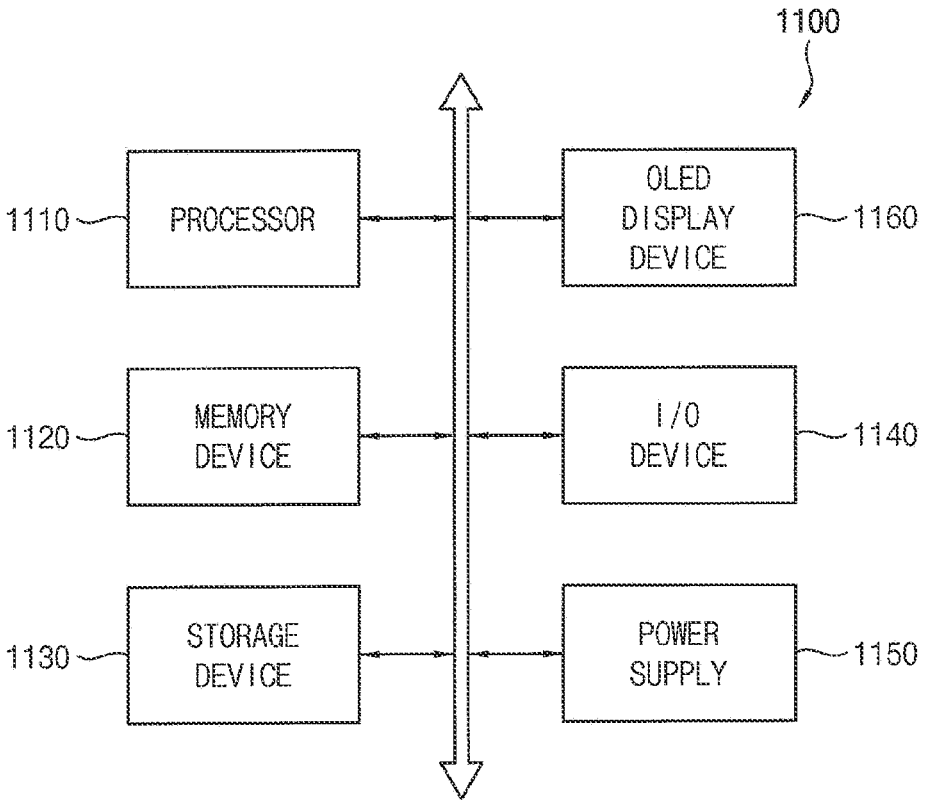
FIG. 10 is a block diagram illustrating an electronic device including an OLED display device according to embodiments.

FIG. 10 is a block diagram illustrating an electronic device including an OLED display device according to embodiments.

Referring to FIG. 10, an electronic device 1100 may include a processor 1110, a memory device 1120, a storage device 1130, an input/output (I/O) device 1140, a power supply 1150, and an OLED display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a microprocessor, a central processing unit (CPU), etc. The processor 1110 may be coupled to other components via an address bus, a control bus, a data bus, etc. Further, The processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAM) device, a magnetic random access memory (MRAM) device, a ferroelectric random access memory (FRAM) device, etc., and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc., and an output device such as a printer, a speaker, etc. The power supply 1150 may supply power for operations of the electronic device 1100. The OLED display device 1160 may be coupled to other components through the buses or other communication links.

In the OLED display device 1160, each pixel may perform a first reset operation that resets a first node (e.g., a gate node) to a first initialization voltage in a first period of a previous horizontal time, and may perform a second reset operation that resets the first node to a second initialization voltage different from the first initialization voltage in a second period of the previous horizontal time. Accordingly, a current path of a first switching transistor of the pixel may have a constant direction from a data line to the first node regardless of a voltage level of a data voltage. Further, a gate-source voltage of the first switching transistor may be sufficient, and a charging rate of the pixel may be desirable.

Embodiments may be applied an electronic device 1100 including an OLED display device 1160. For example, embodiments may be applied to one or more of a television (TV), a digital TV, a 3D TV, a smart phone, a wearable electronic device, a tablet computer, a mobile phone, a personal computer (PC), a home appliance, a laptop computer, a personal digital assistant (PDA), a portable multimedia player (PMP), a digital camera, a music player, a portable game console, a navigation device, etc.

Although example embodiments have been described, many modifications are possible in the example embodiments. All such modifications are within the scope defined in the claims.

What is claimed is:

1. A pixel of a display device, the pixel comprising:

a storage capacitor electrically connected between a first node and a second node;

a first switching transistor configured to electrically connect a data line to the first node in response to a scan signal;

a driving transistor including a gate electrically connected to the first node, a first terminal, and a second terminal electrically connected to the second node;

a second switching transistor configured to electrically connect an initialization line to the second node in response to an initialization signal; and a light emitting element electrically connected to the second node, wherein the first node has a first initialization voltage in a first period of a first horizontal time and has a second initialization voltage unequal to the first initialization voltage in a second period of the first horizontal time.

2. The pixel of claim 1, wherein the second initialization voltage is lower than the first initialization voltage.

3. The pixel of claim 1, wherein the second initialization voltage is lower than a lowest data voltage of the display device.

4. The pixel of claim 1, wherein the first switching transistor is off in each of the first period of the first horizontal time and the second period of the first horizontal time, and wherein the second switching transistor is on in each of the first period of the first horizontal time and the second period of the first horizontal time.

5. The pixel of claim 1, wherein the first switching transistor and the second switching transistor are on in a first period of a second horizontal time subsequent to the first horizontal time and are off in a second period of the second horizontal time.

6. The pixel of claim 5, wherein the first switching transistor transfers a data voltage to the first node in response to the scan signal in the first period of the second horizontal time, and wherein the second switching transistor transfers the first initialization voltage to the second node in the first period of the second horizontal time.

7. The pixel of claim 6, wherein an initial gate-source voltage of the first switching transistor at a start time point of the first period of the second horizontal time is a constant voltage.

8. The pixel of claim 7, wherein the initial gate-source voltage of the first switching transistor is equal to the second initialization voltage subtracted from an on voltage of the scan signal.

9. The pixel of claim 6, wherein a final gate-source voltage of the first switching transistor at an end time point of the first period of the second horizontal time is changed according to the data voltage.

10. The pixel of claim 9, wherein the final gate-source voltage of the first switching transistor is equal to the data voltage subtracted from an on voltage of the scan signal.

11. The pixel of claim 6, wherein a direction of a current path formed between the data line and the first node is unchanged throughout the first period of the second horizontal time regardless of a voltage level of the data voltage.

12. The pixel of claim 11, wherein the direction remains from the data line to the first node throughout the first period of the second horizontal time.

13. The pixel of claim 1, wherein the storage capacitor includes a first electrode electrically connected to the first node, and a second electrode electrically connected to the second node, wherein the first switching transistor includes a gate receiving the scan signal, a first terminal electrically connected to the data line, and a second terminal electrically connected to the first node, wherein the first terminal of the driving transistor receives a first power supply voltage, wherein the second switching transistor includes a gate receiving the initialization signal, a first terminal electrically connected to the second node, and a second terminal electrically connected to the initialization line, and wherein the light emitting element includes an anode electrically connected to the second node, and a cathode receiving a second power supply voltage.

14. The pixel of claim 1, wherein the first switching transistor, the driving transistor, and the second switching transistor are NMOS transistors.

15. A pixel of a display device, the pixel comprising:

a storage capacitor including a first electrode electrically connected to a first node, and a second electrode electrically connected to a second node;

a first switching transistor including a gate receiving a scan signal, a first terminal electrically connected to a data line, and a second terminal electrically connected to the first node;

a driving transistor including a gate electrically connected to the first node, a first terminal receiving a first power supply voltage, and a second terminal electrically connected to the second node;

a second switching transistor including a gate receiving an initialization signal, a first terminal electrically connected to the second node, and a second terminal electrically connected to an initialization line; and a light emitting element including an anode electrically connected to the second node, and a cathode receiving a second power supply voltage, wherein the first node has a first initialization voltage in a first period of a first horizontal time and has a second initialization voltage unequal to the first initialization voltage in a second period of the first horizontal time.

16. A display device comprising:

a display panel including a plurality of pixels, wherein the plurality of pixels includes a pixel;

a data driver configured to provide a data voltage to the pixel;

a scan driver configured to provide a scan signal and an initialization signal to the pixel;

a power management circuit electrically connected through an initialization line to the pixel, providing a first initialization voltage through the initialization line to the pixel in a first period of a first horizontal time, and providing a second initialization voltage unequal to the first initialization voltage through the initialization line to the pixel in a second period of the first horizontal time; and a controller configured to control the data driver, the scan driver, and the power management circuit, wherein the pixel includes:

a storage capacitor electrically connected between a first node and a second node;

a first switching transistor configured to electrically connect a data line to the first node in response to the scan signal;

a driving transistor including a gate electrically connected to the first node, a first terminal, and a second terminal electrically connected to the second node;

a second switching transistor configured to electrically connect the initialization line to the second node in response to the initialization signal; and a light emitting element electrically connected to the second node.

17. The display device of claim 16, wherein the first node has the first initialization voltage throughout the first period of the first horizontal time and has the second initialization voltage throughout the second period of the first horizontal time.

18. The display device of claim 16, wherein the second initialization voltage is lower than the first initialization voltage.

19. The display device of claim 16, wherein the second initialization voltage is lower than a lowest data voltage of the display device.

20. The display device of claim 16, wherein a direction of a current path formed between the data line and the first node is unchanged throughout a first period of a second horizontal time subsequent to the first horizontal time regardless of a voltage level of the data voltage.

* * * * *